US011634652B2

(12) United States Patent
Gee et al.

(10) Patent No.: US 11,634,652 B2
(45) Date of Patent: Apr. 25, 2023

(54) USE OF A PARAFFINIC GASOIL

(71) Applicant: SHELL OIL COMPANY, Houston, TX (US)

(72) Inventors: Michael Gee, London (GB); Rodney Glyn Williams, London (GB); Richard Hugh Clark, Manchester (GB)

(73) Assignee: SHELL USA, INC., Houston, TX (US)

( * ) Notice: Subject to any disclaimer, the term of this patent is extended or adjusted under 35 U.S.C. 154(b) by 0 days.

(21) Appl. No.: 16/627,813

(22) PCT Filed: Jun. 29, 2018

(86) PCT No.: PCT/EP2018/067689
§ 371 (c)(1),
(2) Date: Dec. 31, 2019

(87) PCT Pub. No.: WO2019/007857
PCT Pub. Date: Jan. 10, 2019

(65) Prior Publication Data

US 2020/0165532 A1 May 28, 2020

(30) Foreign Application Priority Data

Jul. 3, 2017 (EP) ..... 17179423

(51) Int. Cl.
*C10L 1/08* (2006.01)
*C10L 10/04* (2006.01)

(52) U.S. Cl.
CPC ..... *C10L 1/08* (2013.01); *C10L 10/04* (2013.01); *C10L 2200/0446* (2013.01); *C10L 2200/0484* (2013.01); *C10L 2200/0492* (2013.01)

(58) Field of Classification Search
CPC .. C10L 10/04; C10L 10/06; C10L 1/08; C10L 2200/0446; C10L 2200/0484; C10L 2200/0492; C10L 2270/026
See application file for complete search history.

(56) References Cited

U.S. PATENT DOCUMENTS

| | | | | |
|---|---|---|---|---|
| 4,125,566 | A | 11/1978 | Trin Dinh et al. | |
| 4,208,190 | A | 6/1980 | Malec | |
| 4,478,955 | A | 10/1984 | Pesa et al. | |
| 7,208,078 | B2 | 4/2007 | Weissman et al. | |
| 9,080,118 | B2 | 7/2015 | Schaberg et al. | |
| 2003/0233785 | A1* | 12/2003 | Weissman | C10L 1/08 208/15 |

(Continued)

FOREIGN PATENT DOCUMENTS

| | | | |
|---|---|---|---|
| EP | 0147873 | A1 | 7/1985 |
| EP | 0583836 | A1 | 2/1994 |
| GB | 2077289 | A | 12/1981 |
| JP | 2007270101 | A | 10/2007 |
| JP | 2007270108 | A | 10/2007 |

OTHER PUBLICATIONS

International Search Report and Written Opinion received for PCT Patent Application No. PCT/EP2018/067689, dated Oct. 15, 2018, 9 pages.

(Continued)

*Primary Examiner* — Latosha Hines
(74) *Attorney, Agent, or Firm* — Shell USA, Inc.

(57) ABSTRACT

Use of a paraffinic gasoil in a diesel fuel composition for reducing the build up of deposits in an Exhaust Gas Recirculation (EGR) system of a compression ignition internal combustion engine.

11 Claims, 1 Drawing Sheet

(56) References Cited

U.S. PATENT DOCUMENTS

| | | | | |
|---|---|---|---|---|
| 2005/0241216 | A1* | 11/2005 | Clark | C10L 1/08 44/436 |
| 2009/0044444 | A1* | 2/2009 | Sugano | C10G 47/02 44/300 |
| 2009/0158641 | A1* | 6/2009 | Hayes | C10L 1/1616 44/309 |
| 2010/0223838 | A1* | 9/2010 | Sugano | C10L 1/08 44/300 |

OTHER PUBLICATIONS

Agarwal et al., "Effect of Exhaust Gas Recirculation (EGR) on Performance, Emissions, Deposits and Durability of a Constant Speed Compression Ignition Engine", Applied Energy, vol. 88, Issue No. 8, Jan. 28, 2011, pp. 2900-2907, XP028158106.

Manni et al., "Impact of Fuel and Oil Quality on Deposits, Wear and Emissions from a Light Duty Diesel Engine with High EGR", SAE Technical Paper Series, Society of Automotive Engineers, vol. 109, No. 2000-01-1913, Jun. 22, 2000, 1-14 pages, XP002257411.

Van Der Burgt et al., "The Shell Middle Distillate Synthesis Process", Studies in Surface Science and Catalysis, vol. 36, 1988.

Office Action Received for Japanese Application No. 2019-569957, dated Mar. 1, 2022, 4 Pages(2 Pages of English Translation and 2 Pages of Official Copy).

Anon, "The basics of EGRs—what they do, how they work, how to troubleshoot" printed from https://www.delphiautoparts.com/usa/en-US/resource-center/basics-egrs-what-they-do-how-they-work-how-troubleshoot on Jan. 22, 2023; 11 pgs.

* cited by examiner

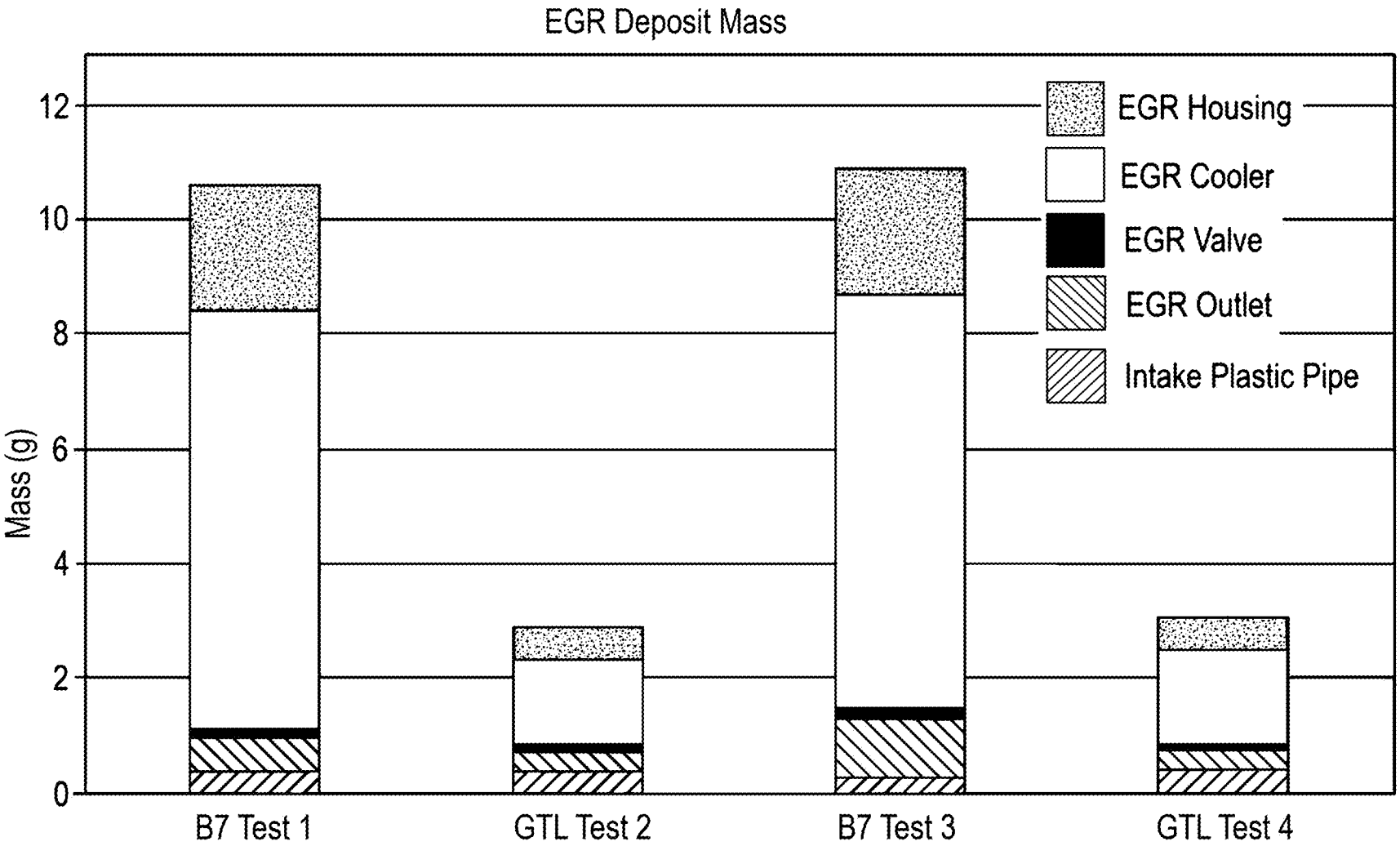
EGR Deposit Mass
EGR Housing
EGR Cooler
EGR Valve
EGR Outlet
Intake Plastic Pipe
Mass (g)
0
2
4
6
8
10
12
B7 Test 1
GTL Test 2
B7 Test 3
GTL Test 4

USE OF A PARAFFINIC GASOIL

CROSS REFERENCE TO EARLIER APPLICATION

The present application is the National Stage (§ 371) of International Application No. PCT/EP2018/067689, filed Jun. 29, 2018, which claims priority from EP Application 17179423.3, filed Jul. 3, 20017 incorporated herein by reference.

FIELD OF THE INVENTION

The present invention relates to the use of a paraffinic gasoil for providing certain benefits in an Exhaust Gas Recirculation (EGR) system in a compression ignition engine. In particular, the present invention relates to the use of a paraffinic gasoil for reducing the build up of deposits in an Exhaust Gas Recirculation system in a compression ignition engine.

BACKGROUND OF THE INVENTION

Exhaust Gas Recirculation (EGR) is a NOx emission control technique applicable to a wide range of diesel engines from light-, medium- and heavy-duty diesel engines systems right up to two-stroke low-speed marine engines. The configuration of an EGR system depends on the required EGR rate and other demands of the particular application. Most EGR systems include the following main hardware components: one or more EGR control valves, one or more EGR coolers, piping, flanges and gaskets.

It has been found that EGR systems have a tendency to become fouled by deposits that build up on the various EGR hardware components. This is a particular problem with high pressure EGR systems. Deposits forming in the system can cause increased NOx emissions and fuel consumption and can cause the system to fail by jamming the EGR valve in severe cases. Oxidation catalysts and/or particulate filters can be fitted before the EGR system to reduce hydrocarbons and particulates from the exhaust gas which cause EGR fouling, but this adds cost and complexity and therefore isn't widely employed by manufacturers. In the case of low pressure EGR, the DPF is situated between the engine and the low pressure EGR system, therefore deposits are not such a problem in these configurations.

It would therefore be desirable to provide a fuel based solution that prevents the formation of deposits in the first instance, and is applicable to all EGR systems, irrespective of the equipment that the manufacturer has employed.

It has now been surprisingly found that by using a paraffinic gasoil in a diesel fuel composition, a surprising and hitherto unrecognised reduction in the build up of EGR deposits can be achieved.

SUMMARY OF THE INVENTION

According to the present invention there is provided the use of a paraffinic gasoil in a diesel fuel composition for reducing the build up of deposits in an Exhaust Gas Recirculation (EGR) system of a compression ignition internal combustion engine.

According to another aspect of the present invention there is provided a method for reducing the build up of deposits in an Exhaust Gas Recirculation (EGR) system of a compression ignition internal combustion engine, which method comprises a step of introducing into said engine a diesel fuel composition which comprises a paraffinic gasoil.

It has been found that use of a paraffinic gasoil in a diesel fuel composition can provide reduced build up of deposits in the EGR system of a compression ignition internal combustion engine.

It has also been found that use of a paraffinic gasoil in a diesel fuel composition can prevent the formation of deposits in the EGR system in the first place and is applicable to all EGR systems, irrespective of the equipment that the manufacturer has employed.

BRIEF DESCRIPTION OF THE DRAWINGS

FIG. 1 is a graphical representation of the results shown in Table 3 below.

DETAILED DESCRIPTION OF THE INVENTION

As used herein there is provided the use of a paraffinic gasoil in a diesel fuel composition for the purpose of reducing the build up of deposits in an EGR system of a compression ignition engine. In the context of this aspect of the invention, the term "reducing the build up of deposits" embraces any degree of reduction in the build up of deposits. The reduction in the build up of deposits may be of the order of 10% or more, preferably 20% or more, more preferably 50% or more, and especially 70% or more compared to the build up of deposits in an EGR system caused by an analogous fuel formulation which does not contain a paraffinic gasoil. As used herein, the term "reducing the build up" also encompasses the prevention of EGR deposit formation in the first place.

It has been found that the present invention is particularly useful in the case of high pressure EGR systems because these systems are more susceptible to deposit build up than low pressure EGR systems.

It is also envisaged that the present invention may be used for the purpose of clean up of existing EGR deposits formed with conventional diesel fuel.

A first essential component herein is a paraffinic gasoil. The paraffinic gasoil fuel is preferably present in the diesel fuel composition herein at a level in the range from 20% v/v to 100% m/m, preferably from 50% v/v to 100% v/v, more preferably from 80% v/v to 100% v/v, even more preferably from 90% v/v to 100% v/v, based on the total diesel fuel composition.

The paraffinic gasoil for use in the present invention can be derived from any suitable source as long as it is suitable for use in a diesel fuel composition.

Suitable paraffinic gasoils include, for example, Fischer-Tropsch derived gasoils, and gasoils derived from hydrogenated vegetable oil (HVO), and mixtures thereof.

From the viewpoint of preventing and reducing EGR deposits, while ensuring other properties such as viscosity, density and distillation properties stay within the requirements of diesel specifications, the paraffinic gasoil used herein is preferably a Fischer-Tropsch derived gasoil fuel. The paraffinic nature of Fischer-Tropsch derived gasoil means that diesel fuel compositions containing it will have high cetane numbers compared to conventional diesel.

While Fischer-Tropsch derived gasoil is the preferred paraffinic gasoil for use herein, the term "paraffinic gasoil" as used herein also includes those paraffinic gasoils derived from the hydrotreating of vegetable oils (HVO). The HVO process is based on an oil refining technology. In the process, hydrogen is used to remove oxygen from the triglyceride vegetable oil molecules and to split the triglyceride into three separate chains thus creating paraffinic hydrocarbons.

In accordance with the presence invention, the paraffinic gasoil for use herein, (i.e. the Fischer-Tropsch derived gasoil, the hydrogenated vegetable oil derived gasoil) will preferably consist of at least 95% w/w, more preferably at least 98% w/w, even more preferably at least 99.5% w/w, and most preferably up to 100% w/w of paraffinic components, preferably iso- and normal paraffins.

By "Fischer-Tropsch derived" is meant that a fuel or base oil is, or derives from, a synthesis product of a Fischer-Tropsch condensation process. The term "non-Fischer-Tropsch derived" may be interpreted accordingly. A Fischer-Tropsch derived fuel may also be referred to as a GTL (gas-to-liquid) fuel.

The Fischer-Tropsch reaction converts carbon monoxide and hydrogen into longer chain, usually paraffinic, hydrocarbons: $n(CO+2H_2)=(—CH_2—)$, $+nH_2O$+heat, in the presence of an appropriate catalyst and typically at elevated temperatures (e.g. 125 to 300° C., preferably 175 to 250° C.) and/or pressures (e.g. 5 to 100 bar, preferably 12 to 50 bar). Hydrogen:carbon monoxide ratios other than 2:1 may be employed if desired.

The carbon monoxide and hydrogen may themselves be derived from organic or inorganic, natural or synthetic sources, typically either from natural gas or from organically derived methane.

Gas oil, kerosene fuel and base oil products may be obtained directly from the Fischer-Tropsch reaction, or indirectly for instance by fractionation of Fischer-Tropsch synthesis products or from hydrotreated Fischer-Tropsch synthesis products. Hydrotreatment can involve hydrocracking to adjust the boiling range (see, e.g. GB2077289 and EP0147873) and/or hydroisomerisation which can improve cold flow properties by increasing the proportion of branched paraffins. EP0583836 describes a two-step hydrotreatment process in which a Fischer-Tropsch synthesis product is firstly subjected to hydroconversion under conditions such that it undergoes substantially no isomerisation or hydrocracking (this hydrogenates the olefinic and oxygen-containing components), and then at least part of the resultant product is hydroconverted under conditions such that hydrocracking and isomerisation occur to yield a substantially paraffinic hydrocarbon fuel or oil. Desired diesel fuel fraction(s) may subsequently be isolated for instance by distillation.

Other post-synthesis treatments, such as polymerisation, alkylation, distillation, cracking-decarboxylation, isomerisation and hydroreforming, may be employed to modify the properties of Fischer-Tropsch condensation products, as described for instance in U.S. Pat. Nos. 4,125,566 and 4,478,955.

Typical catalysts for the Fischer-Tropsch synthesis of paraffinic hydrocarbons comprise, as the catalytically active component, a metal from Group VIII of the periodic table, in particular ruthenium, iron, cobalt or nickel. Suitable such catalysts are described for instance in EP0583836.

An example of a Fischer-Tropsch based process is the SMDS (Shell Middle Distillate Synthesis) described in "The Shell Middle Distillate Synthesis Process", van der Burgt et al (vide supra). This process (also sometimes referred to as the Shell "Gas-to-Liquids" or "GTL" technology) produces diesel range products by conversion of a natural gas (primarily methane) derived synthesis gas into a heavy long-chain hydrocarbon (paraffin) wax which can then be hydroconverted and fractionated to produce liquid transport fuels such as gasoils and kerosene. Versions of the SMDS process, utilising fixed-bed reactors for the catalytic conversion step, are currently in use in Bintulu, Malaysia, and in Pearl GTL, Ras Laffan, Qatar. Kerosenes and (gas)oils prepared by the SMDS process are commercially available for instance from the Royal Dutch/Shell Group of Companies.

By virtue of the Fischer-Tropsch process, a Fischer-Tropsch derived gasoil has essentially no, or undetectable levels of, sulphur and nitrogen. Compounds containing these heteroatoms tend to act as poisons for Fischer-Tropsch catalysts and are therefore removed from the synthesis gas feed. Further, the process as usually operated produces no or virtually no aromatic components.

For example, the aromatics content of a Fischer-Tropsch gasoil, as determined for instance by ASTM D4629, will typically be below 1% w/w, preferably below 0.5% w/w and more preferably below 0.1% w/w.

Generally speaking, Fischer-Tropsch derived fuels have relatively low levels of polar components, in particular polar surfactants, for instance compared to petroleum derived fuels. It is believed that this can contribute to improved antifoaming and dehazing performance. Such polar components may include for example oxygenates, and sulphur and nitrogen containing compounds. A low level of sulphur in a Fischer-Tropsch derived fuel is generally indicative of low levels of both oxygenates and nitrogen-containing compounds, since all are removed by the same treatment processes.

The Fischer-Tropsch derived gasoil fuel used in the present invention is a liquid hydrocarbon middle distillate fuel with a distillation range similar to that of a petroleum derived diesel, that is typically within the 160° C. to 400° C. range, preferably with a T95 of 360° C. or less. Again, Fischer-Tropsch derived fuels tend to be low in undesirable fuel components such as sulphur, nitrogen and aromatics.

The Fischer-Tropsch derived gasoil fuel used in the present invention will typically have a density (as measured by EN ISO 12185) of from 0.76 to 0.80, preferably from 0.77 to 0.79, more preferably from 0.775 to 0.785 g/cm$^3$ at 15° C.

The Fischer-Tropsch derived gasoil fuel used in the present invention preferably has a cetane number (ASTM D613) of greater than 70, suitably from 70 to 85, most suitably from 70 to 77.

The Fischer-Tropsch derived gasoil fuel used in the present invention preferably has a kinematic viscosity at 40° C. (as measured according to ASTM D445) in the range from 2.0 mm$^2$/s to 5.0 mm$^2$/s, preferably from 2.5 mm$^2$/s to 4.0 mm$^2$/s.

The Fischer-Tropsch derived gasoil used in the present invention preferably has a sulphur content (ASTM D2622) of 5 ppmw (parts per million by weight) or less, preferably of 2 ppmw or less.

The Fischer-Tropsch derived gasoil fuel as used in the present invention is that produced as a distinct finished product, that is suitable for sale and used in applications that require the particular characteristics of a gasoil fuel. In particular, it exhibits a distillation range falling within the range normally relating to Fischer-Tropsch derived gasoil fuels, as set out above.

A fuel composition according to the present invention may include a mixture of two or more Fisher-Tropsch derived gasoil fuels.

In accordance with the present invention, the Fischer-Tropsch derived components used herein (i.e. the Fischer-Tropsch derived gasoil) will preferably comprise no more than 3% w/w, more preferably no more than 2% w/w, even more preferably no more than 1% w/w of cycloparaffins (naphthenes), by weight of the Fischer-Tropsch derived component.

The Fischer-Tropsch derived components used herein (i.e. the Fischer-Tropsch derived gasoil) preferably comprise no more than 1% w/w, more preferably no more than 0.5% w/w, of olefins, by weight of the Fischer-Tropsch derived component.

The diesel fuel compositions described herein of the present invention are particularly suitable for use as a diesel fuel, and can be used for arctic applications, as winter grade diesel fuel due to the excellent cold flow properties.

For example, a cloud point of −10° C. or lower (EN 23015) or a cold filter plugging point (CFPP) of −20° C. or lower (as measured by EN 116) may be possible with fuel compositions herein.

The diesel fuel compositions described herein may comprise a diesel base fuel in addition to a paraffinic gasoil.

The diesel base fuel may be any petroleum derived diesel suitable for use in an internal combustion engine, such as a petroleum derived low sulphur diesel comprising <50 ppm of sulphur, for example, an ultra low sulphur diesel (ULSD) or a zero sulphur diesel (ZSD). Preferably, the low sulphur diesel comprises <10 ppm of sulphur.

The petroleum derived low sulphur diesel preferred for use in the present invention will typically have a density from 0.81 to 0.865, preferably 0.82 to 0.85, more preferably 0.825 to 0.845 g/cm$^3$ at 15° C.; a cetane number (ASTM D613) at least 51; and a kinematic viscosity (ASTM D445) from 1.5 to 4.5, preferably 2.0 to 4.0, more preferably from 2.2 to 3.7 mm$^2$/s at 40° C.

In one embodiment, the diesel base fuel is a conventional petroleum-derived diesel.

Generally speaking, in the context of the present invention the fuel composition may be additivated with fuel additives. Unless otherwise stated, the (active matter) concentration of each such additive in a fuel composition is preferably up to 10000 ppmw, more preferably in the range from 5 to 1000 ppmw, advantageously from 75 to 300 ppmw, such as from 95 to 150 ppmw. Such additives may be added at various stages during the production of a fuel composition; those added to a base fuel at the refinery for example might be selected from anti-static agents, pipeline drag reducers, middle distillate flow improvers (MDFI) (e.g., ethylene/vinyl acetate copolymers or acrylate/maleic anhydride copolymers), lubricity enhancers, anti-oxidants and wax anti-settling agents.

The fuel composition may include a detergent, by which is meant an agent (suitably a surfactant) which can act to remove, and/or to prevent the build-up of, combustion related deposits within an engine, in particular in the fuel injection system such as in the injector nozzles. Such materials are sometimes referred to as dispersant additives. Where the fuel composition includes a detergent, preferred concentrations are in the range 20 to 500 ppmw active matter detergent based on the overall fuel composition, more preferably 40 to 500 ppmw, most preferably 40 to 300 ppmw or 100 to 300 ppmw or 150 to 300 ppmw. Detergent-containing diesel fuel additives are known and commercially available. Examples of suitable detergent additives include polyolefin substituted succinimides or succinamides of polyamines, for instance polyisobutylene succinimides or polyisobutylene amine succinamides, aliphatic amines, Mannich bases or amines and polyolefin (e.g. polyisobutylene) maleic anhydrides. Particularly preferred are polyolefin substituted succinimides such as polyisobutylene succinimides.

Other components which may be incorporated as fuel additives, for instance in combination with a detergent, include lubricity enhancers; dehazers, e.g. alkoxylated phenol formaldehyde polymers; anti-foaming agents (e.g. commercially available polyether-modified polysiloxanes); ignition improvers (cetane improvers) (e.g. 2-ethylhexyl nitrate (EHN), cyclohexyl nitrate, di-tert-butyl peroxide and those disclosed in U.S. Pat. No. 4,208,190 at column 2, line 27 to column 3, line 21); anti-rust agents (e.g. a propane-1,2-diol semi-ester of tetrapropenyl succinic acid, or polyhydric alcohol esters of a succinic acid derivative, the succinic acid derivative having on at least one of its alpha-carbon atoms an unsubstituted or substituted aliphatic hydrocarbon group containing from 20 to 500 carbon atoms, e.g. the pentaerythritol diester of polyisobutylene-substituted succinic acid); corrosion inhibitors; reodorants; anti-wear additives; anti-oxidants (e.g. phenolics such as 2,6-di-tert-butylphenol, or phenylenediamines such as N,N'-di-sec-butyl-p-phenylenediamine); metal deactivators; static dissipator additives; and mixtures thereof.

It is preferred that the additive contain an anti-foaming agent, more preferably in combination with an anti-rust agent and/or a corrosion inhibitor and/or a lubricity additive.

It is particularly preferred that a lubricity enhancer be included in the fuel composition, especially when it has a low (e.g. 500 ppmw or less) sulfur content. The lubricity enhancer is conveniently present at a concentration from 50 to 1000 ppmw, preferably from 100 to 1000 ppmw, based on the overall fuel composition.

The (active matter) concentration of any dehazer in the fuel composition will preferably be in the range from 1 to 20 ppmw, more preferably from 1 to 15 ppmw, still more preferably from 1 to 10 ppmw and advantageously from 1 to 5 ppmw. The (active matter) concentration of any ignition improver present will preferably be 600 ppmw or less, more preferably 500 ppmw or less, conveniently from 300 to 500 ppmw.

According to another aspect of the present invention, there is provided the use of one or more additives for reducing the build up of deposits in an Exhaust Gas Recirculation (EGR) system of a compression ignition internal combustion engine system wherein the additive is selected from additives which have one or more of the following functionalities:

Reduction of hydrocarbon emissions;
Reduction of particulate emissions;
Retention of dispersancy post combustion;
Retention of detergency post combustion;
Retention of hydrophilic properties post combustion;
Reduction of smoke emissions;
Reduction of soot oxidation temperature.

The present invention may in particular be applicable where the fuel composition is used or intended to be used in a direct injection diesel engine, for example of the rotary pump, in-line pump, unit pump, electronic unit injector or common rail type, or in an indirect injection diesel engine. The fuel composition may be suitable for use in heavy- and/or light-duty diesel engines, and in engines designed for on-road use or off-road use.

In order to be suitable for at least the above uses, the diesel fuel composition of the present invention preferably has one or more of the following characteristics:

- a kinematic viscosity at 40° C. of 1.9 mm$^2$/s or greater, more preferably in the range from 1.9 to 4.5 mm$^2$/s;
- a density of 800 kg/m$^3$ or greater, more preferably in the range from 800 to 860, even more preferably 800 to 845 kg/m$^3$;

a T95 of 360° C. or less;

a cloud point in the range from 0° C. to −13° C., more preferably from −5° C. to −8° C.;

a CFPP in the range of from −8° C. to −30° C., more preferably from −15° C. to −20° C.

The invention is illustrated by the following non-limiting examples.

EXAMPLES

Two different fuels were used in the examples herein. One fuel was a GTL gasoil containing 10 ppm of a hindered phenol antioxidant (2,6-di-tert-butyl-4-methylphenol otherwise known as BHT).

Table 1 shows the physical and compositional characteristics of the GTL gasoil used in the examples herein. The GTL gasoil was obtained from Pearl GTL, Ras Laffan and is commercially available from the Shell/Royal Dutch Group of Companies. The second fuel was a conventional diesel fuel (Diesel B7). The physical characteristics of the conventional diesel fuel (Diesel B7) used in the examples is shown in Table 2. As used herein "Diesel B7" means diesel base fuel containing 7% biofuel components.

TABLE 1

| Test Parameter | Test Method | Units | |
|---|---|---|---|
| Visual Appearance | Visual | | Clear and bright |

TABLE 1-continued

| Test Parameter | Test Method | Units | |
|---|---|---|---|
| Density at 15° C. | DIN EN ISO 12185 | kg/m$^3$ | 777.9 |
| Distillation | DIN EN ISO 3405 | | |
| IBP | DIN EN ISO 3405 | ° C. | 179.6 |
| 5% v/v | DIN EN ISO 3405 | ° C. | 204.9 |
| 10% v/v | DIN EN ISO 3405 | ° C. | 213.5 |
| 20% v/v | DIN EN ISO 3405 | ° C. | 231.0 |
| 30% v/v | DIN EN ISO 3405 | ° C. | 248.7 |
| 40% v/v | DIN EN ISO 3405 | ° C. | 263.5 |
| 50% v/v | DIN EN ISO 3405 | ° C. | 275.6 |
| 60% v/v | DIN EN ISO 3405 | ° C. | 287.4 |
| 70% v/v | DIN EN ISO 3405 | ° C. | 299.5 |
| 80% v/v | DIN EN ISO 3405 | ° C. | 312.6 |
| 90% v/v | DIN EN ISO 3405 | ° C. | 327.6 |
| 95% v/v | DIN EN ISO 3405 | ° C. | 337.7 |
| FBP | DIN EN ISO 3405 | ° C. | 344.2 |
| Residue & Loss | DIN EN ISO 3405 | % vol | 2.0 |
| E250 | DIN EN ISO 3405 | % vol | 31.4 |
| E300 | DIN EN ISO 3405 | % vol | 71.0 |
| Kinematic Viscosity at 40° C. | DIN EN ISO 3104 | mm$^2$/s | 2.6881 |
| Flashpoint | DIN EN ISO 2719 | ° C. | 74.3 |
| S | DIN EN ISO 20884 | mg/kg | <5 |

TABLE 2

| Test parameter | Test Method | Unit | Limit Min | Limit Max | Result |
|---|---|---|---|---|---|
| Appearance | Visual | | Report | | C&B |
| Cetane Number | EN ISO 5165 | | 51.0 | 54.0 | 52.2 |
| Cetane Index | EN ISO 4264 | | 46.0 | — | 49.8 |
| Density @ 15° C. | EN ISO 12185 | Kg/L | 0.8350 | 0.8450 | 0.8364 |
| Cloud Point | EN ISO 23015 | ° C. | — | −10 | −11 |
| CFPP | EN 116 | ° C. | — | −25 | −30 |
| Carbon Residue (10% Dis. Res.) | EN ISO 10370 | % m/m | — | 0.30 | <0.01 |
| Flash Point | EN ISO 2719 | ° C. | 55.0 | — | 72.0 |
| Lubricity, wear scar diameter @ 60° C. | EN ISO 12156-1 | μm | — | 460 | 190 |
| Sulfur | EN ISO 20846 | mg/kg | 5.0 | 9.0 | 6.1 |
| Viscosity @ 40° C. | EN ISO 3104 | mm$^2$/s | 2.000 | 4.500 | 2.459 |
| Water Content | EN ISO 12937 | mg/kg | — | 200 | 60 |
| FAME Content | EN 14078 | % v/v | 6.0 | 7.0 | 6.6 |
| Mono Aromatics Content | IP 391 mod | % m/m | Report | | 21.7 |
| Polycyclic Aromatics Content | IP 391 mod | % m/m | — | 8.0 | 3.3 |
| Total Aromatics | IP 391 mod | % m/m | 25.0 | 29.0 | 25.0 |
| Oxidation Stability | EN 15751 | H | 20.0 | — | >20.0 |
| Oxidation Stability (16 h) | EN ISO 12205 | g/m3 | — | 25 | 2 |
| Ash Content | EN ISO 6245 | % m/m | — | 0.010 | <0.001 |
| Copper Corrosion (3 h at 50° C.) | EN ISO 2160 | Rating | Report | | 1A |
| Total Contamination | EN 12662 | Mg/kg | — | 24 | 8 |
| Carbon | ASTM D3343 mod | % m/m | Report | | 86.00 |
| Hydrogen | ASTM D3343 mod | % m/m | Report | | 13.34 |
| Oxygen | EN 14078 | % m/m | Report | | 0.66 |
| Gross Calorific Value | ASTM D3338 mod | MJ/kg | Report | | 45.61 |
| Net Calorific Value | ASTM D3338 | MJ/kg | Report | | 42.78 |
| Distillation (Evaporated) | | | | | |
| E250 | EN ISO 3405 | % v/v | — | 65.0 | 46.3 |
| E350 | EN ISO 3405 | % v/v | 85.0 | — | 98.0 |
| E370 | EN ISO 3405 | % v/v | Report | | 98.0 |

TABLE 2-continued

| Test parameter | Test Method | Unit | Limit Min | Limit Max | Result |
|---|---|---|---|---|---|
| IBP | EN ISO 3405 | ° C. | Report | | 174.6 |
| 95% v | EN ISO 3405 | ° C. | — | 360.0 | 343.1 |
| FBP | EN ISO 3405 | ° C. | Report | | 349.4 |

Test Method

The engine used in the examples was a standard PSA DV6 1.6L Euro 5 engine. A clean EGR system was weighed, then fitted to the engine.

The test was run for 24 hours continuously, at 2500 rpm and 5 kW (19 Nm) test condition. The engine coolant temperature was controlled to 37° C. for the entire test duration. When the test was completed, the engine was dismantled, and all EGR components weighed. All EGR components were then photographed, before the entire EGR system was cleaned using solvents and a sonic bath, to remove the deposits. The clean EGR system was then reweighed before being fitted to the engine to run the next test. The tests toggled between B7 and GTL fuel. Two tests were run on each fuel.

The results of these experiments are shown in Table 3 below.

TABLE 3

| | Mass of deposit g | | | | | |
|---|---|---|---|---|---|---|
| | EGR intake plastic pipe | EGR outlet pipe | EGR valve | EGR cooler | EGR housing | Total |
| B7 Test 1 | 0.35 | 0.58 | 0.18 | 7.3 | 2.21 | 10.62 |
| GTL Test 2 | 0.37 | 0.2 | 0.15 | 1.57 | 0.62 | 2.91 |
| B7 Test 3 | 0.28 | 0.98 | 0.23 | 7.2 | 2.180 | 10.87 |
| GTL Test 4 | 0.43 | 0.29 | 0.15 | 1.63 | 0.58 | 3.08 |

FIG. 1 is a graph of the Results set out in Table 3.

DISCUSSION

As can be seen from the results in Table 3 and the graph in FIG. 1, there is a significant reduction in the amount of deposits formed on the EGR components in the case of the GTL fuel compared with the conventional diesel B7 fuel.

That which is claimed is:

1. A method for reducing build up of deposits in a high-pressure Exhaust Gas Recirculation (EGR) system of a compression ignition internal combustion engine, the method comprising the steps of:

providing a compression ignition internal combustion engine having a high-pressure EGR system and a particulate filter, wherein the particulate filter is positioned downstream of the high pressure EGR;

introducing into the engine a diesel fuel composition comprising:

a paraffinic gasoil present at a level of from 50% v/v to 100% v/v, based on the total diesel fuel composition, wherein the paraffinic gasoil is selected from a Fischer-Tropsch derived gasoil comprising no more than 3% w/w of cycloparaffins, by weight of the Fischer-Tropsch derived gasoil and having a kinematic viscosity in a range from 2.0 to 5.0 $mm^2/s$ at 40° C., a density in a range from 0.775 to 0.785 $g/cm^3$, an aromatics content below 0.1% w/w and a cetane number from 70 to 77, and a hydrotreated vegetable oil (HVO) derived gasoil, and mixtures thereof; and combusting the diesel fuel composition;

wherein deposits in the EGR system after the fuel composition has been combusted in the compression ignition internal combustion engine for 24 hours continuously, at 2500 rpm and 5 kW test condition and at an engine coolant temperature controlled to 37° C., are reduced by 10% or more compared to the build up of deposits in an EGR system caused by an analogous fuel formulation which does not contain a paraffinic gasoil.

2. The method of claim 1 wherein the paraffinic gasoil comprises greater than 95wt % paraffins, based on the total weight of the paraffinic gasoil.

3. The method of claim 1 wherein the paraffinic gasoil comprises greater than 98wt % paraffins, based on the total weight of the paraffinic gasoil.

4. The method of claim 1 wherein the diesel fuel composition additionally comprises a diesel base fuel.

5. The method of claim 1 wherein the paraffinic gasoil is present in the diesel fuel composition at a level in the range from 80% v/v to 100% v/v, based on the total diesel fuel composition.

6. The method of claim 1 wherein the paraffinic gasoil is present in the diesel fuel composition at a level in a range from 90% v/v to 100% v/v, based on the total diesel fuel composition.

7. The method of claim 1 wherein the Fischer-Tropsch derived gasoil has a kinematic viscosity in the range from 2.5 to 5.0 $mm^2/s$ at 40° C.

8. The method of claim 1 wherein the Fischer-Tropsch derived gasoil comprises no more than 2% w/w of cycloparaffins, by weight of the Fischer-Tropsch derived gasoil.

9. The method of claim 1 wherein the Fischer-Tropsch derived gasoil comprises no more than 1% w/w of cycloparaffins, by weight of the Fischer-Tropsch derived gasoil.

10. The method of claim 1 wherein the build up of deposits is reduced in one or more of the EGR outlet pipe, EGR valve, EGR cooler or EGR housing of the high-pressure Exhaust Gas Recirculation (EGR) system.

11. The method of claim 1 wherein the build up of deposits is reduced in the EGR cooler of the high-pressure Exhaust Gas Recirculation (EGR) system.

* * * * *